US006783728B2

(12) United States Patent
Kano et al.

(10) Patent No.: US 6,783,728 B2
(45) Date of Patent: Aug. 31, 2004

(54) FREE-CUTTING STEEL FOR MACHINE STRUCTURAL USE HAVING GOOD MACHINABILITY IN CUTTING BY CEMENTED CARBIDE TOOL

(75) Inventors: Takashi Kano, Nagoya (JP); Yutaka Kurebayashi, Nagoya (JP)

(73) Assignee: Daido Steel Co., Ltd., Nagoya (JP)

( * ) Notice: Subject to any disclaimer, the term of this patent is extended or adjusted under 35 U.S.C. 154(b) by 55 days.

(21) Appl. No.: 10/163,571

(22) Filed: Jun. 7, 2002

(65) Prior Publication Data

US 2003/0113223 A1 Jun. 19, 2003

(30) Foreign Application Priority Data

Jun. 8, 2001 (JP) ..... 2001-174606
Nov. 21, 2001 (JP) ..... 2001-356402

(51) Int. Cl.[7] ..... C22C 38/60; C22C 38/02

(52) U.S. Cl. ..... 420/84; 420/85; 420/87

(58) Field of Search ..... 420/84, 85, 87

(56) References Cited

U.S. PATENT DOCUMENTS 4,210,444 A * 7/1980 Bellot ..... 420/84
4,431,445 A * 2/1984 Furusawa et al. ..... 420/84

* cited by examiner

*Primary Examiner*—Deborah Yee
(74) *Attorney, Agent, or Firm*—Varndell & Varndell, PLLC

(57) ABSTRACT

Disclosed is a free-cutting steel for machine structural use which always exhibits desired machinability, particularly, machinability by cutting with cemented carbide tools. This free-cutting steel is produced by preparing a molten alloy of the composition consisting essentially of, by weight %, C: 0.05–0.8%, Si: 0.01–2.5%, Mn: 0.1–3.5% and O: 0.0005–0.01%, the balance being Fe and inevitable, and adjusting the addition amounts of Al and Ca in such a manner as to satisfy the above ranges, S: 0.01–0.2%, Al: 0.001–0.020% and Ca: 0.0005–0.02%, and the conditions of [S]/[O]: 8–40 [Ca]×[S]: $1\times10^{-5}$–$1\times10^{-3}$ [Ca]/[S]: 0.01–20 and [Al]: 0.001–0.020% to obtain a steel characterized in that the area in microscopic field occupied by the sulfide inclusions containing Ca of 1.0% or more neighboring to oxide inclusions containing CaO of 8–62% is $2.0\times10^{-4}$ $mm^2$ or more per 3.5 $mm^2$.

10 Claims, 5 Drawing Sheets

SEM Image

FREE-CUTTING STEEL FOR MACHINE STRUCTURAL USE HAVING GOOD MACHINABILITY IN CUTTING BY CEMENTED CARBIDE TOOL

BACKGROUND OF THE INVENTION

The present invention concerns a free-cutting steel for machine structural use having good machinability in cutting by cemented carbide tools, such as turning with a cemented carbide tool or drilling with a cemented carbide drill. The invention also concerns a method of preparing the free-cunning steel. The steel for machine structural use according to the invention is suitable for material of machine parts produced by machining with cemented carbide tools such as crankshafts and connecting rods, for which abrasion of tools and roughness of turned surface are problems.

In the present invention the term "double structure inclusion" means inclusions of the structure in which an inclusion consisting mainly of sulfides is surrounding a core of another inclusion consisting mainly of oxides. The terms "tool life ratio" and "life ratio" mean a ratio of tool life of the free-cutting steel according to the invention to tool life of the conventional sulfur-free-cutting steel containing the same S-contents in turning with a cemented carbide tool.

Research and development on machine structural use having high machinability have been made for many years, and the applicant has made many proposals. In recent years Japanese patent disclosure 10-287953 bearing the title "Steel for machine structural use having good mechanical properties and drilling machinability" is mentioned as one of the representative technologies. The free-cutting steel of this invention is characterized by calcium-manganese sulfide inclusion containing 1% or more of Ca in a spindle shape with an aspect ratio (length/width) up to 5, which envelopes a core of calcium aluminate containing 8–62% of CaO. Though the steel exhibited excellent machinability, dispersion of the machinability has been sometimes experienced. This was considered to be due to variety of types of the above-mentioned calcium-manganese sulfide inclusion.

The applicant disclosed in Japanese patent disclosure 2000-34534 "Steel for machine structural use having good machinability in turning" that, with classification of Ca-containing sulfide inclusions into three groups by Ca-contents observed as the area percentages in microscopic field, A: Ca-content more than 40%, B: Ca-content 0.3–40%, and C; Ca-content less than 0.3%, a steel satisfying the conditions, $A/(A+B+C) \leqq 3$ and $B/(A+B+C) \geqq 0.1$, brings about very prolonged tool life in turning Further research by the applicant succeeded, as disclosed in Japanese patent disclosure 2000-219936 "Free-cutting steel", in decreasing the dispersion of the machinability by clarifying necessary number of inclusion particles in the steel. The steel of this invention is characterized in that it contains five or more particles per 3.3 $mm^2$ of equivalent diameter 5 $\mu$m or more of sulfide inclusion containing 0.1–1% of Ca. There was, however, still some room for improving the dispersion of the machinability.

SUMMARY OF THE INVENTION

The object of the invention is not only to clarify the form of the inclusions allowing good machinability, i.e., the above-mentioned double structure inclusions, but also to grasp the effect of manufacturing conditions on the form of the inclusions, and thereby to provide a free-cutting steel for machine structural use which always exhibits desired machinability, particularly, by cutting with cemented carbide tools, as well as the method for producing such a free-cutting steel. In this invention the inventors aimed at such improvement in machinability that achieves fivefold or more in the above-defined tool life ratio.

The free-cutting steel for machine structural use according to the present invention achieving the above-mentioned object, has an alloy composition consisting essentially of, as the basic alloy components, by weight %. C: 0.05–0.8%, Si: 0.01–2.5%, Mn: 0.1–3.5%, S: 0.01–0.2%, Al: 0.001–0.020%, Ca: 0.0005–0.02% and O: 0.0005–0.01%, the balance being Fe and inevitable Impurities, and is characterized in that the area in microscopic field occupied by the sulfide inclusions containing Ca of 1.0% or more neighboring to oxide inclusions containing CaO of 8–62% is $2.0\times10^{-4}$ $mm^2$ or more per 3.5 $mm^2$.

DETAILED EXPLANATION OF THE PREFERRED EMBODIMENTS

The following explains reasons for determining the basic alloy composition of the present free-cutting steel as noted above.

C: 0.05–0.08%

Carbon is an element necessary for ensuring strength of the steel, and at content less than 0.05% the strength is insufficient for a machine structural use. On the other hand, carbon enhances the activity of sulfur, and at a high C-content it will be difficult to obtain the double structure inclusion which can be obtained only under the specific balance of [S]/[O], [Ca][S], [Ca]/[S] and specific amount of [Al]. Also, a large amount of C lowers resilience and machinability of the steel, and the upper limit of 0.8% is thus decided.

Si: 0.1–2.5%

Silicon is used as a deoxidizing agent at steel making and become a component of the steel to increase hardenability of the steel. These effects are not available at such a small Si-content less than 0.1%. Si also enhances the activity of S. A large Si-content causes the same problem as caused by a large amount of C, and it is apprehensive that formation of the double structure inclusion may be prevented. A large content of Si damages ductility of the steel and cracks may occur at plastic processing. Thus, 2.5% is the upper limit of addition.

Mn: 0.5–3.0%

Manganese is an essential element to form sulfides Mn-content less than 0.1% gives insufficient amount of sulfides, while an excess amount more than 3.5% hardens the steel to decrease machinability.

S: 0.01–0.2%

Figure 2:
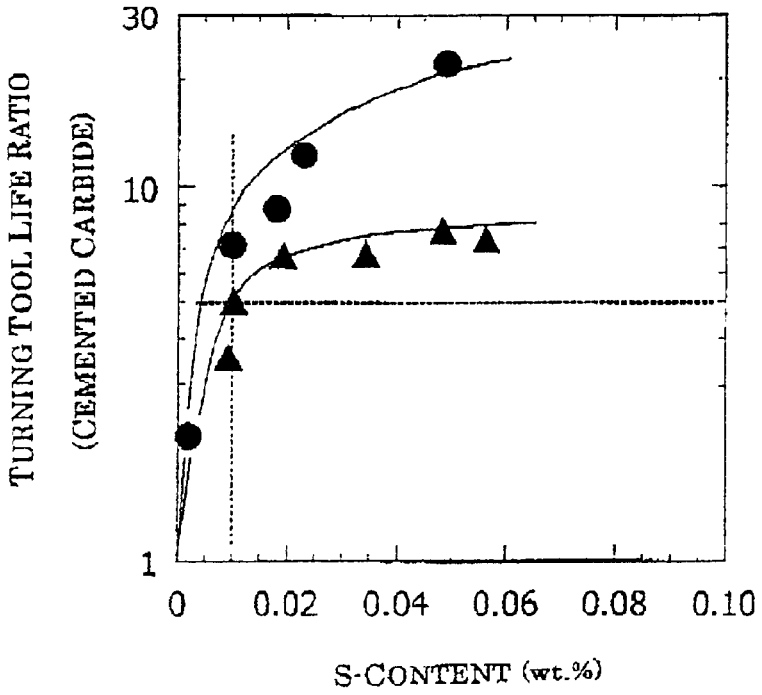
FIG. 2 is a graph showing the relation between S-content and tool life of free-cutting steels for machine structural use.

Sulfur is rather necessary than useful for improving machinability of the steel, and therefore, at least 0.01% of S is added. Plotting relation between S-content and tool life is in FIG. 2. The graph shows that it is necessary for achieving the aim of fivefold tool life to add S of 0.01% or more. S-content more than 0.2% not only damages resilience and ductility, but also causes formation of CaS, which has a high melting point and becomes difficulty in casting the steel Al: 0.001–0.020%

Aluminum is necessary for realizing suitable composition of oxide inclusions and is added in an amount at least 0.001%. At higher Al-content of 0.020% or more hard alumina cluster will form and lowers machinability of the steel.

Ca: 0.0005–0.02%

Calcium is a very important component of the steel according to the invention. In order to have Ca contained in the sulfides it is essential to add at least 0.0005% of Ca. On the other hand, addition of Ca more than 0.02% causes, as mentioned above, formation of high melting point CaS, which will be difficulty in casting step.

O: 0.0005–0.0050%

Oxygen is an element necessary for forming the oxides. In the extremely deoxidized steel high melting point CaS will form and be troublesome for casting, and therefore, at least 0.0005%, preferably 0.015% or more of O is necessary. On the other hand, O of 0.01% or more will give much amount of hard oxides, which makes it difficult to form the desired calcium sulfide and damages machinability of the steel.

Phosphor is in general harmful for resilience of the steel and existence in an amount more than 0.2% is unfavorable. However, in this limit content of P in an amount of 0.0015 or more contributes to improvement in machinability, particularly terned surface properties.

The free-cutting steel of this invention may further contain, in addition to the above-discussed basic alloy components, at least one element selected from the respective groups in an amount or amounts defined below. The following explains the roles of the optionally added alloying elements in the modified embodiments and the reasons for limiting the composition ranges.

(1) One or more of Cr: up to 3.5%, Mo: up to 2.0%, Ni: up to 4.0%, Cu: up to 2.0% and B: 0.0005–0.01%

Chromium and molybdenum enhance hardenability of the steel, and so, it is recommended to add a suitable amount or amounts of these elements. However, addition of a large amount or amounts will damage hot workability of the steel and causes cracking. Also from the view point of manufacturing cost the respective upper limits are set to be 3.5% for Cr and 2.0% for Mo.

Nickel also enhances hardenability of the steel. This is a component unfavorable to the machinability. Taking the manufacturing cost into account, 4.0% is Chosen as the upper limit Copper makes the structure fine and heightens strength of the steel. Much addition is not desirable from the view points of hot workability and machinability. Addition amount should be up to 2.0%.

Boron enhances hardenability of the steel even at a small content. To obtain this effect addition of B of 0.0005% or more is necessary. B-content more than 0.01% is harmful due to decreased hot workability.

(2) One or more of Nb; up to 0.2%, Ti: up to 0.2%, V: up to 0.5% and N: 0.001–0.04%

Niobium is useful for preventing coarsening of crystal grains of the steel at high temperature. Because the effect saturates as the addition amount increases, it is advisable to add Nb in an amount up to 0.2%.

Titanium combines with nitrogen to form TiN which enhances the hardenability-increasing effect by boron. If the amount of TiN is too much, hot workability of the steel will be lowered. The upper limit of Ti-addition is thus 0.2%.

Vanadium combines with carbon and nitrogen to form carbonitride, which makes the crystal grains of the steel fine. This effect saturates at V-content more than 0.5%.

Nitrogen is a component effective to prevent coarsening of the crystal grains. To obtain this effect an N-content of 0.001% or more is necessary. Because excess amount of N may bring about defects in cast ingots, the upper limit 0.04% was decided.

(3) One or more of Ta: up to 0.5%, Zr: up to 0.5% and Mg: up to 0.02%

Both tantalum and zirconium are useful for making the crystal grains fine and increasing resilience of the steel, and it is recommended to add one or both. It is advisable to limit the addition amount (in case of adding the both, in total) up to 0.5% where the effect saturates.

Addition of magnesium in a suitable amount is effective for finely dispersing the oxides in the steel. Addition of a large amount of Mg results in, not only saturation of the effect, but also decreased formation of the double structure inclusion. The upper limit, 0.2%, is set for this reason.

(4) Pb: up to 0.4%, Bi: up to 0.4%., Se: up to 0.4%, Te: up to 0.2%, Sn: up to 0.1% and Tl: up to 0.05%

Both lead and bismuth are machinability-improving elements. Lead exists, as the inclusion in the steel, alone or with sulfide in the form of adhering on outer surface of the sulfide and improves machinability. The upper limit, 0.4%, is set because, even if a larger amount is added, excess lead will not dissolve in the steel and coagulate to form defects in the steel ingot. The reason for setting the upper limit of Bi is the same.

The other elements, Se, Te, Sn and Tl are also machinability-improving elements. The respective upper limits of addition, 0.4% for Se, 0.2% for Te, 0.1% for Sn and 0.05% for Tl were decided on the basis of unfavorable influence on hot workability of the steel.

The method of producing the above-explained free-cutting steel for machine structural use according to the invention comprises, with respect to the steel of the basic alloy composition, preparing a molten alloy consisting essentially of, by weight %, C: 0.05–0.8%, Si: 0.01–2.5%, Mn: 0.1–3.54, S: 0.01–0.2%. Al: 0.001–0.020%, Ca: 0.0005–0.02% and O: 0.0005–0.01%, the balance being Fe and inevitable impurities by melting and refining process the same as done in conventional steel making, and by adjusting the addition amounts of Al and Ca in such a manner as to satisfy the above ranges, S: 0.01–0.2%, Al: 0.001–0.020% and Ca: 0.0005–0.02%, and the conditions of

[S]/[O]: 8–40

[Ca]×[S]: $1\times10^{-5}{}_{-1\times10}{}^{-3}$

[Ca]/[S]: 0.01–20 and

[Al]; 0.001–0.020%.

The method of producing the free-cutting steel for machine structural use containing the optionally added alloy components according to the invention comprises is, though principally the same as the case of basic alloy compositions, characterized by different timing of addition of the alloying element or elements depending on the kinds of the optionally added elements. The reason for different timingis due to the importance of producing the intended double structure inclusion and maintaining the formed inclusion. More specifically, it is necessary for, obtaining the double structure inclusion to add Ca to the molten steel of suitably deoxidized state. This is because for forming CaO without forming excess CaS. At this step, if Al is added in a large amount, the state of deoxidation changes. Thus, it is necessary to take care of impurities in the additives for adding the alloying elements. The following describes the detail.

In case of the group consisting of Cr, Mo, Cu and Ni, they are added prior to the composition adjustment for forming the double structure inclusion. In other words, an alloy consisting essentially of, by weight a in addition to C: 0.05–0.8, Si: 0.01–2.5%. Mn: 0.1–3.5%, S: 0.01–0.2%, Al: 0.001–0.020%, Ca: 0.0005–0.02% and O: 0.0005–0.01%, at least one of Cr: up to 3.5%, Mo: up to 2.0%, Cu: up to 2.0%, Ni: up to 4.0% and B: 0.0005–001%, the balance being Fe and inevitable impurities is prepared by melting and refining process the same as done in conventional steel making, and then, the above described operation and the addition of the alloying elements are carried out.

In case of the group consisting of Nb, Ti, V and N, addition of these elements can be carried out either before or after the adjustment of the composition. If, however, an additive or additives contain Al is used, for example, addition of V is carried out by throwing ferrovanadium into the molten steel, the alloying elements are added after the adjustment due to the reason discussed above. In detail, an alloy consisting essentially of, by weight %, in addition to C: 0.05–0.8%, Si: 0.01–2.5%, Mn: 0.1–3.5%, S: 0.01–0.2%, Al: 0.001–0.020%, Ca: 0.0005–0.02% and O: 0.0005–0.01%, and optionally, at least one of Cr: up to 3.5%, Mo: up to 2.0%, Cu: up to 2.0%, Ni: up to 4.0% and B: 0.0005–0.01%, the balance being Fe and inevitable impurities is prepared by melting and refining process the same as done in conventional steel making, and after the operation to form the above described double structure inclusion, addition of the alloying element or elements selected from the group of Nb, Ti, V and N. The reason for addition after the adjustment of composition is to maintain the balance of components for production of the double structure inclusion. If the additional Al may destroy the S—Ca—Al balance, it is necessary to choose an additive which contains substantially no or small amount of Al.

In case of the group consisting of Ta, Zr and Mg, the method is substantially the same as the method described above for the group of Nb, Ti, V and N.

Contrary to this, in case of the group consisting of Pb, Bi, Se, Te, Sn, Sb and Tl, they are added prior to the composition adjustment for producing the double structure inclusion. In other words, a molten alloy consisting essentially of, by weight %, in addition to C: 0.05–0.8%, Si: 0.01–2.5%, Mn: 0.1–3.5%, S: 0.01–0.2%, Al: 0.001–0.020%, Ca; 0.0005–0.02% and O: 0.0005–0.01%, at least one of Pb: up to 0.4%, Bi: up to 0.4%. Se: up to 0.4%, Te: up to 0.2%, Sn: up to 0.1% and Tl: up to 0.05%, the balance being Fe and inevitable impurities is prepared by melting and refining process the same as done in conventional method of making a steel for machine structural use, and the above described operation is carried out. This is because, if the addition of the alloying elements is done after formation of the double structure inclusion, the molted steel Is stirred by this addition and it is possible that the formed double structure inclusion may rise to the surface of the molted steel to separate A typical shape of the inclusion found in the free-cutting steel for machine structural use according to the invention is shown by the SEM image in FIG. 1. The inclusion has a double structure, and EPMA analysis revealed that the core consists of oxides of Ca, Mg, Si and Al, and the core is surrounded by MnS containing CaS The structure of the inclusion is essential for achieving good machinability of fivefold tool life ratio aimed at by the present invention through the mechanism discussed later, and the requisites for realizing this inclusion structure are the operation conditions described above. The following explains the significance of the conditions.

The area in microscopic field occupied by the sulfide inclusions containing Ca of 1.0% or more neighboring to the oxide inclusions containing CaO of 8–62%: $2.0\times10^{-4}$% $mm^2$ or more per 3.5 $mm^2$.

Figure 3:
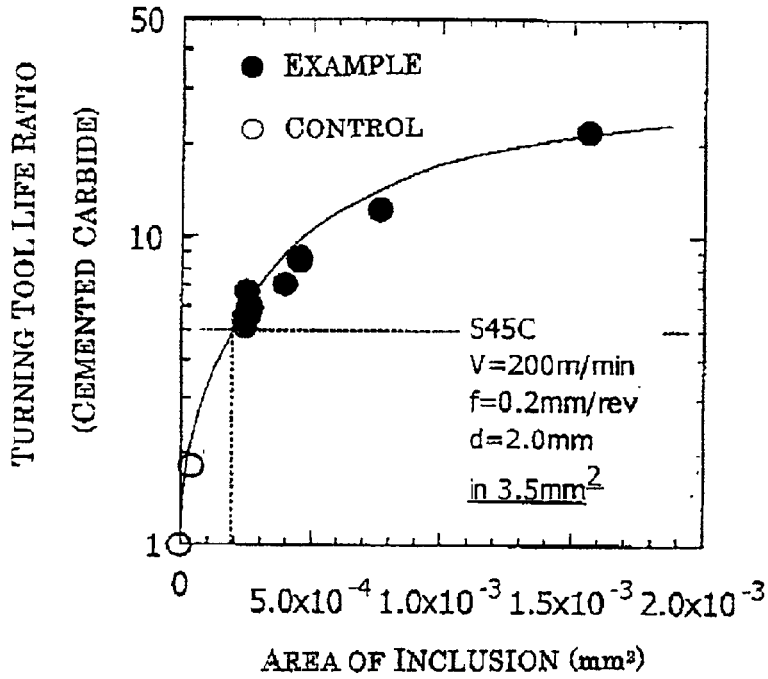
FIG. 3 is a graph showing the relation between area occupied by the "double structure inclusion" and tool life of free-cutting steel for machine structural use.

The relation between the area occupied by the inclusion satisfying the above condition and tool life ratio obtained by turning with cemented carbide tool of the present steel and the conventional sulfur-free-cutting steel of the same S-content is shown in FIG. 3. The data in FIG. 3 were obtained by turning S45C-series free-cutting steel of the invention, and show that the results of fivefold tool life ratio is achieved only when the double structure inclusion occupies the area of $2.0\times10^4$ $mm^2$ or more

[Al]: 0.001–0.020%

Figure 4:
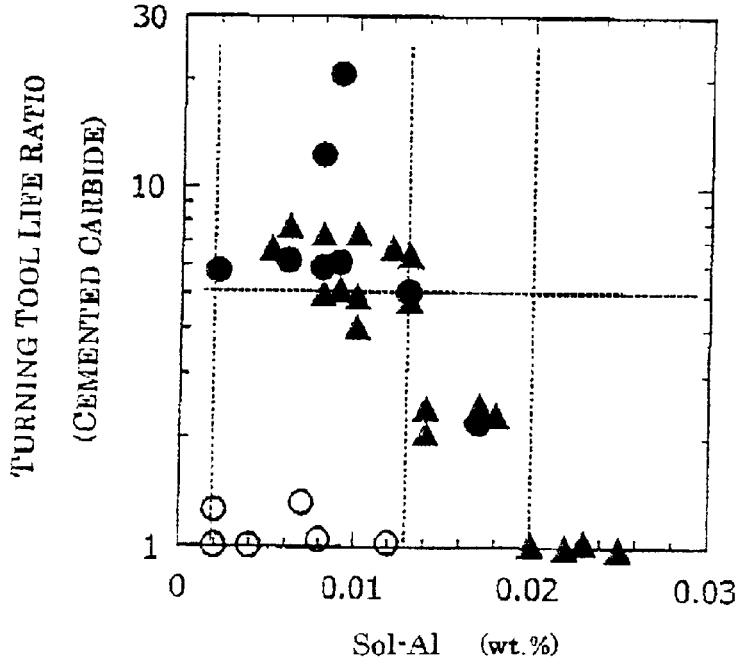
FIG. 4 is a graph obtained by plotting the relation between Al-content and tool life of free-cutting steel for machine structural use.

By plotting the relation between [Al] and the tool life of free-cutting steel for machine structural use the graph of FIG. 4 was obtained. This graph shows necessity of [Al] in the above-defined range for achieving the fivefold tool life ratio aimed at by the invention.

[S]/[O]: 8–40

Figure 5:
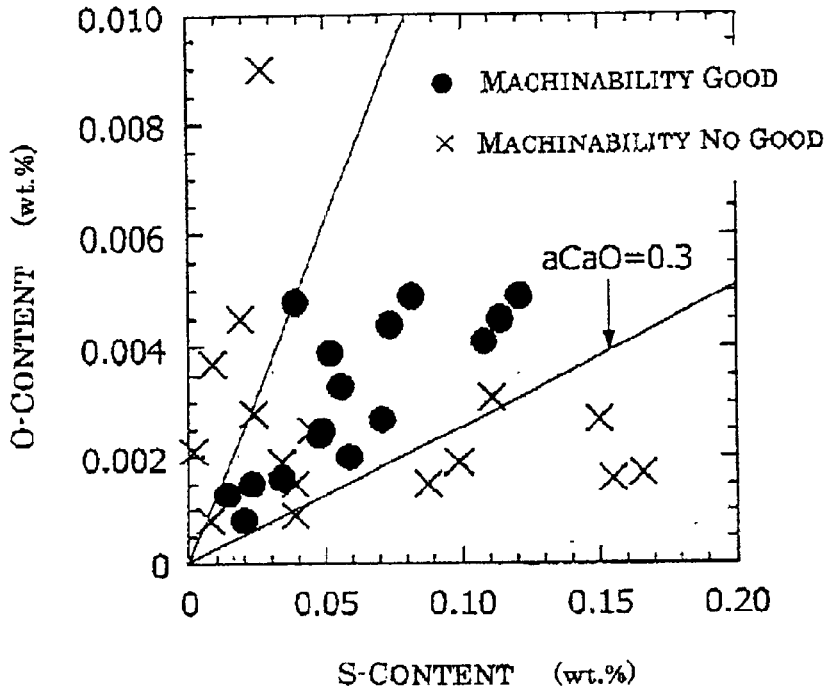
FIG. 5 is a graph showing whether the aim of this invention, the fivefold tool life ratio is achieved by the free-cutting steel with various S-contents and O-contents.

Whether the aim of fivefold tool life ratio is achieved or not in relation to the steel of various S-contents and O-contents is shown by different plots in the graph of FIG. 5. Those successful (with ● plots) are in the triangle area between the line of [S]/[O]-8 and the line of [S]/[O]=40, and those not successful (with X plots) are out of the triangle area.

[Ca]/[S]: 0.01-20 and

[Ca]×[S]: $1\times10^{-5}$–$1\times10^{-3}$

Figure 6:
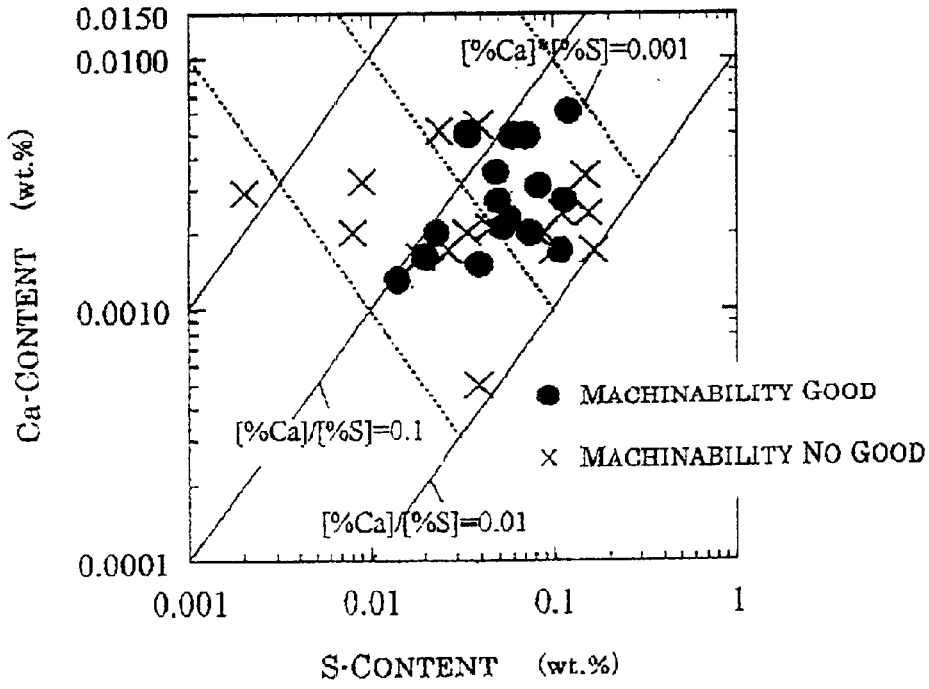
FIG. 6 is a graph showing whether the aim of this invention, the fivefold tool life ratio is achieved by the free-cutting steel with various S-contents and Ca-contents.

Like the above data, whether the aim of fivefold tool life ratio is achieved or not in relation to the steel of various S-contents and Ca-contents is shown in the graph of FIG. 6. It will be seen from the graph that those successful (with ● plots) are concentrated in the quadrilateral area surrounded by the lines of [Ca]/[S]=0.01 and 20 and lines of [Ca]×[S] and $1\times10^{-3}$. All of those fulfilling the above conditions concerning [I]/[O], [Ca]/[S] and [Ca]×[S] achieved the aim of fivefold tool life ratio.

As the reason for the good machinability in cutting by cemented carbide tool of the machine structural use according to the invention the inventors consider the following mechanism of improved protection and lubrication by the double structure inclusion.

Figure 1:
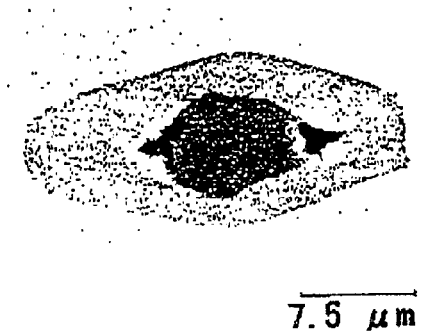
FIG. 1 is a microscopic photograph showing the shape of inclusions in the free-cutting steel according to the present invention.

The double structure inclusion as shown in FIG. 1 has a core of $CaO.Al_2O_3$-based composite oxides and the circumference of the core is surrounded by (Ca, Mn)-based composite sulfides. These oxides In question have relatively low melting points out of the $CaO.Al_2O_3$-based oxides, while the composite sulfide has a melting point higher than that of simple sulfide or MnS. The double structure inclusion surely precipitates by such arrangement that the $CaO.Al_2O_3$-based oxide of a low melting point may be in the form that the sulfides envelop the oxides. It is well known that the inclusions soften to coat the surface of the tool to protect it. If the inclusion is only the sulfide, formation and duration of the coating film is not stable, however, according to the discovery by the inventors coexistence of low melting point oxide of $CaO.Al_2O_3$-base with the sulfide brings about stable formation of the coating film and further, the composite sulfide of (Ca,Mn)S-base has lubricating effect better than that of simple MnS.

The significance of formation of coating film on the tool edge by the composite sulfide of (Ca,Mn)S-base is to suppress so-called "heat diffusion abrasion" of cemented carbide tools. The heat diffusion abrasion is the abrasion of the tools caused by embrittlement of the tool through the mechanism that the tool contacts cut tips coming from the material just cut at a high temperature followed by thermal decomposition of carbide, represented by tungsten carbide WC, and resulting loss of carbon by diffusion into the cut tips. If a coating of high lubricating effect is formed on the tool edge, temperature increase of the tool will be prevented and diffusion of carbon will thus be suppressed.

The double structure inclusion $CaO—Al_2O_3/(Ca,Mn)S$ can be interpreted to have the merit of MnS, which is the inclusion in the conventional sulfur-free-cutting steel, and the merit given by anorthite inclusion, $CaO.Al_2O_3.\ 2SiO_2$ which is the inclusion in the conventional calcium-free-cutting steel, in combination. The MnS inclusion exhibits lubricating effect on the tool edge, while the stability of the coating film is somewhat dissatisfactory, and has no competence against the heat diffusion abrasion. On the other hand, $CaO.Al_2O_3.2SiO_2$ forms a stable coating film to prevent the thermal diffusion abrasion, while has little lubrication effect. The double structure inclusion of the present invention forms a stable coating film to effectively prevent the thermal diffusion abrasion and at the same time offer better lubricating effect.

Formation of the double structure inclusion begins with, as mentioned above, preparation of the low melting temperature composite oxides, and therefore, the amount of [Al] is important. At least 0.001% of [Al] is essential. However, if [Al] is too much the melting point of the composite oxide will increase, and thus, the amount of [Al] must be up to 0.020%. Then, for the purpose of adjusting the amount of CaS formed the values of [Ca]×[S] and [Ca]/[S] are controlled to the above mentioned levels.

Figure 7:
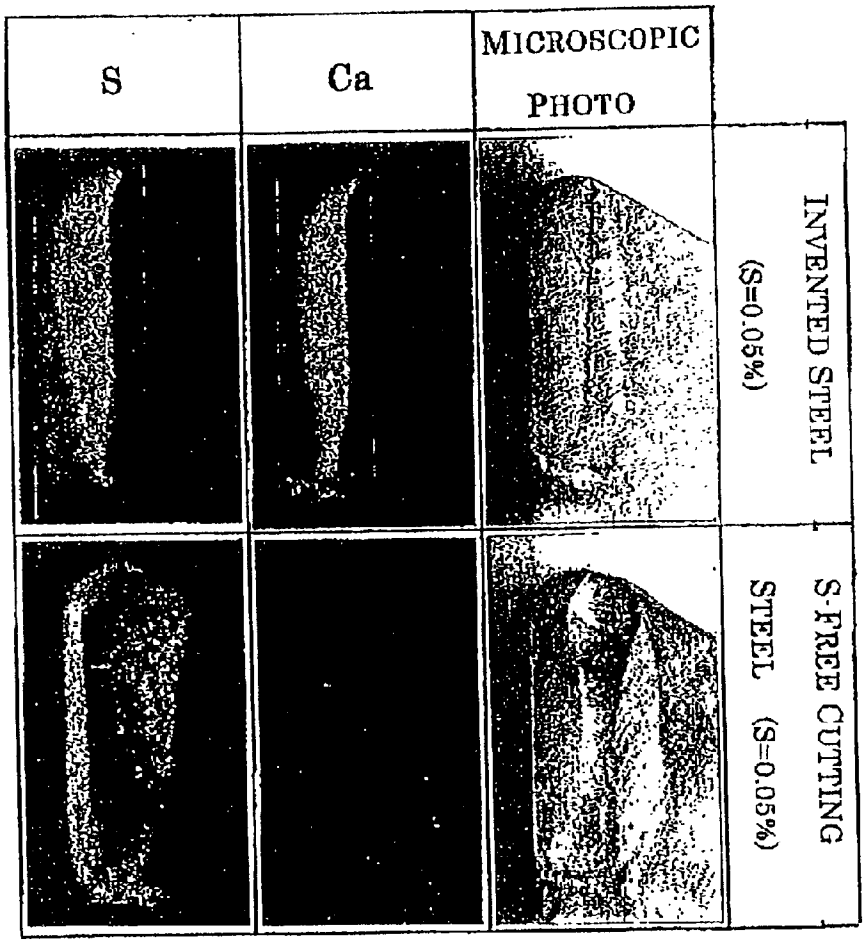
FIG. 7 is a microscopic photograph showing the surface of a cemented carbide tool used for cutting the free-cutting steel for machine structural use according to the invention, and a photograph showing the analysis of components in adhered melted inclusions by an electron beam microanalyzer.

The above-discussed mechanism is not just a hypothesis, but accompanied by evidence. FIG. 7, microscopic photographs, show the surfaces of cemented carbide tools used for turning the free-cutting steel according to the invention and analysis of the melted, adhered inclusion, in comparison with the case of turning conventional sulfur-free-cutting steel. The tool, which turned the present free-cutting steel, has the appearance of abraded edge clearly different from that of the conventional technology. From analysis of the adhered inclusions it is ascertained that sulfur is contained in both the inclusions to show formation of sulfide coating film. On the tool turned the present free-cutting steel adhesion of remarkable amount of Ca to support that the coating film is (Ca,Mn)S-based one. By contrast, no Ca is detected in the inclusion adhered to the edge which cut the conventional sulfur-free-cutting steel.

Figure 8:
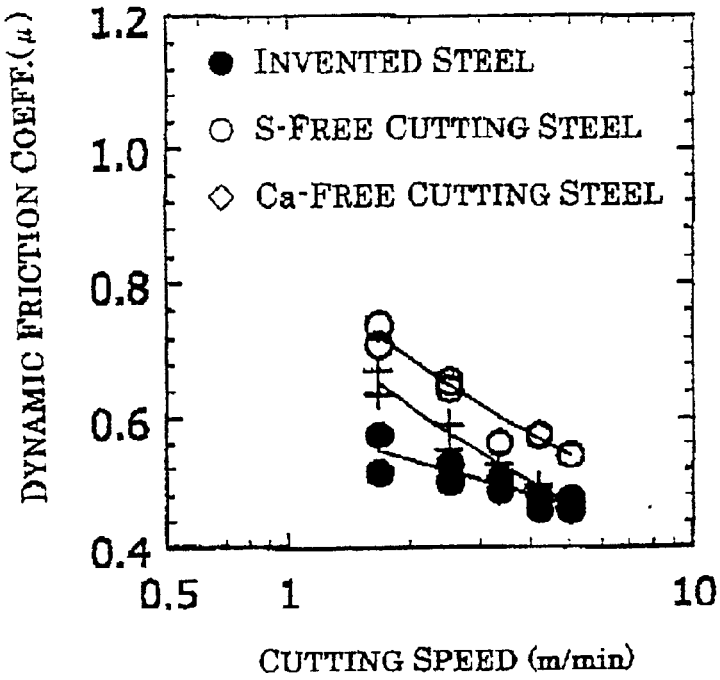
FIG. 8 is a graph showing dynamic friction coefficient given by the inclusions softened and melted on a tool in comparison with those of conventional sulfur-free-cutting steel and calcium-free-cutting steel.

FIG. 8 compares dynamic friction coefficients of inclusions softened and melted on tools of the three kinds: that of a sulfur-free-cutting steel (MnS), that of calcium-free-cutting steel (anorthite) and that of the present free-cutting steel (double structure inclusion) measured In a certain range of cutting speed. From the graph of FIG. 8 excellent lubricating effect of the present double structure inclusion is understood.

In the free-cutting steel for machine structural use according to the present invention inclusions which bring about good machinability, particularly, the double structure inclusion exists in the best form. Thus, it is easy to obtain such a good machinability as achieving the aim of the invention, fivefold tool life ratio to the conventional sulfur-free-cutting steel in turning with a cemented carbide tool.

With respect to the known free-cutting steel research and study on the inclusion which may give good machinability has been made to some extent. However, there has not been found satisfactory way to produce such inclusions with high reproducability. The present invention established a breakthrough in the free-cutting steel technology. By carrying out the above-explained operation procedures it is always possible to produce the free-cutting steel for machine structural use having good machinability to cemented carbide tools.

EXAMPLES

In the following working examples and control examples the free-cutting steels were produced by melting materials for steel in an arc furnace, adjusting the alloy composition in a ladle furnace, adjusting the oxygen content by vacuum degassing, followed by addition of S, Ca and Al, and in some cases after addition of further alloying elements to obtain the alloy of the compositions shown in the tables below. The molten steels were cast Into ingots, from which test pieces of round rods having diameter of 72 mm were taken. The test pieces were subjected to turning with a cemented carbide tool under the following conditions.

Cutting Tool: Cemented carbide "K10"
Cutting Speed: 200 m/min
Feed Rate: 0.2 mm/rev
Depth of Cut: 2.0 mm Both in the successful case where the desired inclusion was obtained, and the case where the protection by the inclusion was obtained, the results were recorded "Yes", while in the not successful case the results were recorded "No". Taking the tool lives of the sulfur-free-cutting steels in which S-contents are 0.01–0.2% as standards, the steels which achieved the aim of the invention, fivefold tool life ratio, were marked "Yes" and the steels which failed to achieve the above aim were marked "No".

Example 1

The invention was applied on S45C steel. The alloy compositions are shown in TABLE 1 (working examples) and TABLE 2 (control examples), and the component ratios, or characterizing values of [S]/[O], $[Ca]\cdot[S]\times10^{-3}$ and [Ca]/[S] are shown together with the form of the inclusions, formation of protecting film and machinability in TABLE 3 (working examples) and TABLE 4 (control examples).

Example 2

The same production and tests for machinability as those in Example 1 were applied to S15C steel The alloy compositions are shown in TABLE 5 (working examples) and TABLE 6 (control examples), and the above characterizing values together with the testing results are shown in TABLE 7 (working examples) and TABLE 8 (control examples).

Example 3

The same production and tests for machinability as those in Example 1 were applied to S55C steel. The alloy compositions are shown in TABLE 9 (working examples) and TABLE 10 (control examples), and the above characterizing values together with the testing results are shown in TABLE 11 (working examples) and TABLE 12 (control examples)

Example 4

The same production and tests for machinability as those in Example 1 were applied to S55C steel The alloy compositions are shown in TABLE 13 (working examples) and TABLE 14 (control examples), and the above characterizing values together with the testing results are shown in TABLE 15 (working examples) and TABLE 16 (control examples).

Example 5

The same production and tests for machinability as those in Example 1 were applied to S55C steel. The alloy compositions are shown in TABLE 17 (working examples) and TABLE 18 (control examples), and the above characterizing values together with the testing results are shown in TABLE 19 (working examples) and TABLE 20 (control examples).

TABLE 1

S45C Working Examples

| | Alloy Compositions (wt. %, balance Fe) | | | | | | | | |
|---|---|---|---|---|---|---|---|---|---|
| No. | C | Si | Mn | S | Ca | Al | O | Ti | Others |
| A1 | 0.44 | 0.18 | 0.81 | 0.039 | 0.0015 | 0.006 | 0.0048 | 0.0041 | — |
| A2 | 0.44 | 0.25 | 0.78 | 0.014 | 0.0013 | 0.008 | 0.0013 | — | — |
| A3 | 0.45 | 0.32 | 0.75 | 0.052 | 0.0021 | 0.002 | 0.0039 | — | Mg 0.0033 |
| A4 | 0.43 | 0.31 | 0.80 | 0.023 | 0.0020 | 0.014 | 0.0015 | — | Pb 0.07 |
| A5 | 0.41 | 0.27 | 0.78 | 0.082 | 0.0031 | 0.005 | 0.0049 | — | — |
| A6 | 0.46 | 0.25 | 0.74 | 0.074 | 0.0020 | 0.005 | 0.0044 | 0.0050 | — |
| A7 | 0.47 | 0.25 | 0.74 | 0.056 | 0.0023 | 0.005 | 0.0033 | — | Zr 0.0050 |
| A8 | 0.45 | 0.26 | 0.80 | 0.049 | 0.0027 | 0.003 | 0.0025 | 0.0049 | Mg 0.0021 |
| A9 | 0.44 | 0.27 | 0.74 | 0.049 | 0.0035 | 0.005 | 0.0024 | 0.0065 | Mg 0.0034<br>Pb 0.07 |
| A10 | 0.44 | 0.24 | 0.74 | 0.034 | 0.0050 | 0.008 | 0.0016 | — | — |
| A11 | 0.44 | 0.25 | 0.91 | 0.121 | 0.0061 | 0.002 | 0.0049 | 0.0075 | — |
| A12 | 0.44 | 0.25 | 0.74 | 0.020 | 0.0016 | 0.006 | 0.0008 | 0.0044 | — |
| A13 | 0.45 | 0.26 | 0.89 | 0.114 | 0.0017 | 0.004 | 0.0045 | — | Bi 0.04 |
| A14 | 0.44 | 0.24 | 0.75 | 0.070 | 0.0049 | 0.004 | 0.0027 | — | — |
| A15 | 0.46 | 0.24 | 0.89 | 0.108 | 0.0017 | 0.002 | 0.0041 | — | REM 0.0044 |
| A16 | 0.46 | 0.25 | 0.75 | 0.059 | 0.0049 | 0.006 | 0.0020 | 0.0095 | Pb 0.15 |

TABLE 2

S45C Control Examples

| | Alloy Compositions (wt. %, balance Fe) | | | | | | | | |
|---|---|---|---|---|---|---|---|---|---|
| No. | C | Si | Mn | S | Ca | Al | O | Ti | Others |
| a1 | 0.45 | 0.25 | 0.74 | 0.002 | 0.0029 | 0.006 | 0.0021 | — | — |
| a2 | 0.45 | 0.26 | 0.76 | 0.009 | 0.0032 | 0.010 | 0.0037 | 0.0041 | — |
| a3 | 0.45 | 0.25 | 0.76 | 0.027 | 0.0017 | 0.013 | 0.0090 | — | — |
| a4 | 0.45 | 0.25 | 0.75 | 0.019 | 0.0016 | 0.009 | 0.0045 | 0.0090 | Mg 0.0055 |
| a5 | 0.44 | 0.25 | 0.78 | 0.024 | 0.0051 | 0.009 | 0.0028 | 0.0075 | — |
| a6 | 0.44 | 0.25 | 0.76 | 0.008 | 0.0020 | 0.006 | 0.0008 | 0.0044 | Mg 0.0057<br>Pb 0.06 |
| a7 | 0.44 | 0.25 | 0.77 | 0.039 | 0.0005 | 0.008 | 0.0015 | — | Mg 0.0040<br>Bi 0.04 |
| a8 | 0.42 | 0.24 | 0.81 | 0.111 | 0.0024 | 0.006 | 0.0031 | 0.0050 | Mg 0.0038 |
| a9 | 0.46 | 0.24 | 0.77 | 0.039 | 0.0054 | 0.002 | 0.0009 | — | — |
| a10 | 0.44 | 0.24 | 0.77 | 0.099 | 0.0017 | 0.005 | 0.0019 | — | — |
| a11 | 0.44 | 0.24 | 0.76 | 0.150 | 0.0034 | 0.010 | 0.0027 | 0.0050 | — |
| a12 | 0.45 | 0.20 | 0.77 | 0.088 | 0.0020 | 0.005 | 0.0015 | 0.0044 | — |
| a13 | 0.46 | 0.30 | 0.80 | 0.155 | 0.0024 | 0.009 | 0.0016 | — | — |
| a14 | 0.44 | 0.18 | 0.76 | 0.166 | 0.0017 | 0.007 | 0.0017 | — | — |
| a15 | 0.45 | 0.26 | 0.77 | 0.045 | 0.0021 | 0.025 | 0.0025 | — | — |
| a16 | 0.41 | 0.26 | 0.80 | 0.034 | 0.0020 | 0.034 | 0.0034 | — | — |

TABLE 3

S45C Working Examples

| | Ratios of Components and Machinability | | | | | |
|---|---|---|---|---|---|---|
| No. | [S]/[O] | [Ca][S] × $10^{-5}$ | [Ca]/[S] | Inclusions | Protecting Film | Machinability |
| A1 | 8.1 | 5.9 | 0.038 | — | Yes | B |
| A2 | 4.1 | 10.8 | 0.093 | Yes | Yes | B |
| A3 | 13.3 | 10.9 | 0.040 | Yes | Yes | B |
| A4 | 15.3 | 4.6 | 0.087 | No | Yes | A |
| A5 | 16.7 | 25.4 | 0.038 | Yes | Yes | A |
| A6 | 16.8 | 14.8 | 0.027 | No | Yes | A |
| A7 | 17.0 | 12.9 | 0.041 | Yes | Yes | A |
| A8 | 19.6 | 13.2 | 0.055 | Yes | Yes | A |
| A9 | 20.0 | 16.8 | 0.073 | No | Yes | A |
| A10 | 21.3 | 17.0 | 0.147 | No | Yes | A |
| A11 | 24.7 | 73.8 | 0.050 | No | Yes | A |
| A12 | 25.0 | 3.2 | 0.080 | Yes | Yes | A |

TABLE 3-continued

S45C Working Examples

| | Ratios of Components and Machinability | | | | | |
|---|---|---|---|---|---|---|
| No. | [S]/[O] | [Ca][S] × $10^{-5}$ | [Ca]/[S] | Inclu-sions | Protecting Film | Machinability |
| A13 | 25.3 | 30.8 | 0.024 | No | Yes | A |
| A14 | 26.3 | 34.8 | 0.069 | No | Yes | A |
| A15 | 26.3 | 18.4 | 0.016 | Yes | Yes | A |
| A16 | 29.5 | 28.9 | 0.083 | Yes | Yes | A |

TABLE 4

S45C Control Examples

| | Ratios of Components and Machinability | | | | | |
|---|---|---|---|---|---|---|
| No. | [S]/[O] | [Ca][S] × $10^{-5}$ | [Ca]/[S] | Inclu-sions | Protecting Film | Machinability |
| a1 | 1.0 | 0.6 | 1.045 | No | No | B |
| a2 | 2.4 | 2.9 | 0.356 | — | No | B |
| a3 | 3.0 | 4.6 | 0.063 | — | No | B |
| a4 | 4.2 | 3.0 | 0.084 | No | No | B |
| a5 | 8.6 | 12.2 | 0.213 | — | No | B |
| a6 | 10.0 | 1.6 | 0.250 | — | No | B |
| a7 | 26.0 | 2.0 | 0.013 | — | No | C |
| a8 | 35.8 | 26.6 | 0.022 | — | No | C |
| a9 | 43.3 | 21.1 | 0.138 | — | No | C |
| a10 | 52.1 | 16.8 | 0.017 | — | No | C |
| a11 | 55.6 | 51.0 | 0.023 | — | No | C |
| a12 | 58.7 | 17.6 | 0.023 | — | No | C |
| a13 | 96.9 | 37.2 | 0.015 | — | No | C |
| a14 | 97.6 | 37.2 | 0.015 | No | No | C |
| a15 | 18.0 | 9.5 | 0.047 | No | No | C |
| a16 | 17.9 | 6.8 | 0.059 | — | No | C |

TABLE 5

S15C Working Examples

| | Alloy Compositions (wt. %, balance Fe) | | | | | | | | | |
|---|---|---|---|---|---|---|---|---|---|---|
| No. | C | Si | Mn | P | S | Ca | Al | O | Cr | Mo |
| B1 | 0.15 | 0.22 | 0.54 | 0.017 | 0.018 | 0.0025 | 0.014 | 0.0011 | 0.15 | 0.01 |
| B2 | 0.16 | 0.39 | 0.44 | 0.023 | 0.041 | 0.0021 | 0.011 | 0.0022 | 0.15 | 0.01 |
| B3 | 0.14 | 0.27 | 1.00 | 0.020 | 0.089 | 0.0017 | 0.002 | 0.0040 | 0.03 | 0.01 |
| B4 | 0.14 | 0.41 | 0.80 | 0.025 | 0.077 | 0.0017 | 0.007 | 0.0033 | 0.02 | 0.01 |

TABLE 6

S15C Control Examples

| | Alloy Compositions (wt. %, balance Fe) | | | | | | | | | |
|---|---|---|---|---|---|---|---|---|---|---|
| No. | C | Si | Mn | P | S | Ca | Al | O | Cr | Mo |
| b1 | 0.15 | 0.33 | 0.39 | 0.016 | 0.015 | 0.0001 | 0.016 | 0.0021 | 0.12 | 0.01 |
| b2 | 0.16 | 0.32 | 0.62 | 0.016 | 0.091 | 0.0034 | 0.022 | 0.0019 | 0.09 | 0.01 |
| b3 | 0.14 | 0.23 | 0.31 | 0.024 | 0.055 | 0.0006 | 0.001 | 0.0188 | 0.11 | 0.01 |

TABLE 7

S15C Working Examples

| | Ratios of Components and Machinability | | | | |
|---|---|---|---|---|---|
| No. | [S]/[O] | [Ca][S] × $10^{-5}$ | [Ca]/[S] | Inclusions | Machinability |
| B1 | 16.4 | 4.5 | 0.139 | Yes | A |
| B2 | 18.6 | 8.6 | 0.051 | Yes | A |
| B3 | 22.3 | 15.1 | 0.019 | Yes | A |
| B4 | 23.3 | 13.1 | 0.022 | Yes | A |

TABLE 8

S15C Control Examples

| | Ratios of Components and Machinability | | | | |
|---|---|---|---|---|---|
| No. | [S]/[O] | [Ca][S] × $10^{-5}$ | [Ca]/[S] | Inclusions | Machinability |
| b1 | 7.1 | 0.2 | 0.007 | No | C |
| b2 | 47.9 | 30.9 | 0.037 | No | B |
| b3 | 2.9 | 3.3 | 0.011 | No | C |

TABLE 9

S55C Working Examples

| | Alloy Compositions (wt. %, balance Fe) | | | | | | | | | |
|---|---|---|---|---|---|---|---|---|---|---|
| No. | C | Si | Mn | P | S | Ca | Al | O | Cr | Mo |
| C1 | 0.55 | 0.29 | 0.88 | 0.020 | 0.024 | 0.0011 | 0.010 | 0.0011 | 0.15 | 0.01 |
| C2 | 0.55 | 0.34 | 1.02 | 0.017 | 0.080 | 0.0021 | 0.011 | 0.0020 | 0.15 | 0.01 |
| C3 | 0.54 | 0.47 | 0.77 | 0.011 | 0.111 | 0.0031 | 0.008 | 0.0034 | 0.11 | 0.01 |

TABLE 10

S55C Control Examples

| | Alloy Compositions (wt. %, balance Fe) | | | | | | | | | |
|---|---|---|---|---|---|---|---|---|---|---|
| No. | C | Si | Mn | P | S | Ca | Al | O | Cr | Mo |
| c1 | 0.56 | 0.83 | 0.99 | 0.015 | 0.017 | 0.0001 | 0.029 | 0.0027 | 0.15 | 0.01 |
| c2 | 0.56 | 0.37 | 0.86 | 0.022 | 0.453 | 0.0023 | 0.161 | 0.0010 | 0.10 | 0.01 |
| c3 | 0.54 | 0.15 | 0.45 | 0.015 | 0.045 | 0.0023 | 0.019 | 0.0009 | 0.15 | 0.01 |

TABLE 11

S55C Working Examples

| | Ratios of Components and Machinability | | | | |
|---|---|---|---|---|---|
| No. | [S]/[O] | [Ca][S] × $10^{-5}$ | [Ca]/[S] | Inclusions | Machinability |
| C1 | 21.8 | 2.6 | 0.046 | Yes | A |
| C2 | 40.0 | 16.8 | 0.026 | Yes | A |
| C3 | 32.6 | 34.4 | 0.028 | Yes | A |

TABLE 12

S55C Control Examples

| | Ratios of Components and Machinability | | | | |
|---|---|---|---|---|---|
| No. | [S]/[O] | [Ca][S] × $10^{-5}$ | [Ca]/[S] | Inclusions | Machinability |
| c1 | 6.3 | 0.2 | 0.006 | No | C |
| c2 | 452.0 | 104.0 | 0.005 | No | C |
| c3 | 50.0 | 10.4 | 0.051 | No | C |

TABLE 13

SCr415 Working Examples

| | Alloy Compositions (wt. %, balance Fe) | | | | | | | | | |
|---|---|---|---|---|---|---|---|---|---|---|
| No. | C | Si | Mn | P | S | Ca | Al | O | Cr | Mo |
| D1 | 0.15 | 0.26 | 0.55 | 0.018 | 0.019 | 0.0028 | 0.019 | 0.0022 | 0.15 | 0.01 |
| D2 | 0.16 | 0.08 | 0.73 | 0.022 | 0.031 | 0.0019 | 0.021 | 0.0014 | 0.10 | 0.01 |
| D3 | 0.15 | 0.25 | 0.65 | 0.015 | 0.051 | 0.0020 | 0.011 | 0.0024 | 0.15 | 0.01 |

TABLE 14

SCr415 Control Examples

| | Alloy Compositions (wt. %, balance Fe) | | | | | | | | | |
|---|---|---|---|---|---|---|---|---|---|---|
| No. | C | Si | Mn | P | S | Ca | Al | O | Cr | Mo |
| d1 | 0.15 | 0.27 | 0.82 | 0.011 | 0.025 | 0.0025 | 0.002 | 0.0045 | 3.30 | 0.01 |
| d2 | 0.15 | 0.07 | 0.66 | 0.018 | 0.071 | 0.0007 | 0.034 | 0.0007 | 1.20 | 0.01 |
| d3 | 0.15 | 0.31 | 1.02 | 0.025 | 0.200 | 0.0044 | 0.014 | 0.0022 | 1.20 | 0.01 |

TABLE 15

SCr415 Working Examples

| No. | Ratios of Components and Machinability | | | | |
|---|---|---|---|---|---|
| | [S]/[O] | [Ca][S] × $10^{-5}$ | [Ca]/[S] | Inclusions | Machinability |
| D1 | 8.6 | 5.3 | 0.147 | Yes | A |
| D2 | 22.1 | 5.9 | 0.061 | Yes | A |
| D3 | 21.3 | 10.2 | 0.039 | Yes | A |

TABLE 16

SCr415 Control Examples

| No. | Ratios of Components and Machinability | | | | |
|---|---|---|---|---|---|
| | [S]/[O] | [Ca][S] × $10^{-5}$ | [Ca]/[S] | Inclusions | Machinability |
| d1 | 5.6 | 6.3 | 0.100 | No | B |
| d2 | 101.4 | 5.0 | 0.010 | No | C |
| d3 | 90.9 | 66.0 | 0.017 | No | B |

TABLE 17

SCM440 Working Examples

| No. | Alloy Compositions (wt. %, balance Fe) | | | | | | | | | |
|---|---|---|---|---|---|---|---|---|---|---|
| | C | Si | Mn | P | S | Ca | Al | O | Cr | Mo |
| E1 | 0.41 | 0.30 | 0.77 | 0.023 | 0.020 | 0.0015 | 0.002 | 0.0029 | 1.02 | 0.10 |
| E2 | 0.39 | 0.21 | 0.60 | 0.023 | 0.049 | 0.0021 | 0.010 | 0.0020 | 1.11 | 0.15 |
| E3 | 0.39 | 0.19 | 0.71 | 0.017 | 0.095 | 0.0019 | 0.008 | 0.0028 | 2.17 | 0.33 |
| E4 | 0.43 | 0.23 | 0.31 | 0.015 | 0.101 | 0.0031 | 0.006 | 0.0032 | 1.34 | 0.75 |

TABLE 18

SCM440 Control Examples

| No. | Alloy Compositions (wt. %, balance Fe) | | | | | | | | | |
|---|---|---|---|---|---|---|---|---|---|---|
| | C | Si | Mn | P | S | Ca | Al | O | Cr | Mo |
| e1 | 0.44 | 0.19 | 0.75 | 0.010 | 0.015 | 0.0019 | 0.010 | 0.0022 | 1.10 | 0.12 |
| e2 | 0.41 | 0.40 | 0.44 | 0.022 | 0.207 | 0.0025 | 0.008 | 0.0022 | 2.07 | 0.51 |
| e3 | 0.39 | 0.40 | 0.25 | 0.031 | 0.030 | 0.0077 | 0.020 | 0.0012 | 1.45 | 0.79 |
| e4 | 0.41 | 0.20 | 0.81 | 0.045 | 0.043 | 0.0009 | 0.027 | 0.0008 | 1.20 | 0.44 |

TABLE 19

SCM440 Working Examples

| No. | Ratios of Components and Machinability | | | | |
|---|---|---|---|---|---|
| | [S]/[O] | [Ca][S] × $10^{-5}$ | [Ca]/[S] | Inclusions | Machinability |
| E1 | 9.1 | 9.1 | 0.075 | Yes | A |
| E2 | 24.5 | 24.5 | 0.043 | Yes | A |
| E3 | 33.9 | 33.9 | 0.020 | Yes | A |
| E4 | 31.6 | 31.9 | 0.031 | Yes | A |

TABLE 20

SCM440 Control Examples

| No. | Ratios of Components and Machinability | | | | |
|---|---|---|---|---|---|
| | [S]/[O] | [Ca][S] × $10^{-5}$ | [Ca]/[S] | Inclusions | Machinability |
| e1 | 6.8 | 6.8 | 0.127 | No | B |
| e2 | 94.1 | 94.1 | 0.012 | No | B |
| e3 | 25.0 | 25.0 | 0.257 | No | C |
| e4 | 53.8 | 53.8 | 0.021 | No | C |

What is claimed is:

1. A free-cutting steel for machine structural use consisting essentially of, by weight %, C: 0.05–0.8%, Si: 0.01–2.5%, Mn: 0.1–3.5%, S: 0.01–0.2%, Al: 0.001–0.019%, Ca: 0.0005–0.02% and O: 0.0005–0.01%, the balance being Fe and inevitable impurities, and is characterized in that the area in microscopic field occupied by the sulfide inclusions containing Ca of 1.0% or more neighboring to oxide inclusions containing CaO of 8–62% is $2.0\times10^{-4}$ $mm^2$ or more per 3.5 $mm^2$.

2. The free-cutting steel according to claim 1, wherein the steel further contains, in addition to the alloy components set forth in claim 1, one or more of Cr: up to 3.5%, Mo: up to 2.0%, Cu: up to 2.0%, Ni: up to 4.0% and B: 0.0005–0.01%.

3. The free-cutting steel according to claim 1, wherein the steel further contains, in addition to the alloy components set forth in claim 1, one or more of Nb: up to 0.2%, Ti: up to 0.2%, V: up to 0.5% and N: up to 0.04%.

4. The free-cutting steel according to claim 1, wherein the steel further contains, in addition to the alloy components set forth in claim 1, one or more of Ta: up to 0.5%, Zr: up to 0.5% and Mg: up to 0.02%.

5. The free-cutting steel according to claim 1, wherein the steel further contains, in addition to the alloy components set forth in claim 1, one or more of Pb: up to 0.4%, Bi: up to 0.4%, Se: up to 0.4%, Sn: up to 0.1%, Sb: up to 0.1% and Ti: up to 0.05%.

6. A method of producing the free-cutting steel for machine structural use having good machinability in machining with a cemented carbide tool set forth in claim 1, comprising the steps of preparing an alloy consisting essentially of, by weight %, C: 0.05–0.8%, Si: 0.01–2.5%, Mn: 0.1–3.5% and O: 0.0005–0.01%, the balance being Fe and inevitable impurities by melting and refining process for the conventional steel making, and adjusting the addition amounts of Al and Ca in such a manner as to satisfy the above ranges, S: 0.01–0.2%, Al: 0.001–0.019%, and Ca: 0.0005–0.02%, and the conditions of

[S]/[O]: 8–40

[Ca]×[S]: $1\times10^{-5}$–$1\times10^{-3}$

[Ca]/[S]: 0.01–20 and

[Al]: 0.001–0.019%.

7. A method of producing the free-cutting steel for machine structural use having good machinability in machining with a cemented carbide tool set forth in claim 2, comprising the steps of preparing an alloy consisting essentially of, by weight %, C: 0.05–0.8%, Si: 0.01–2.5%, Mn: 0.1–3.5% and O: 0.0005–0.01%, and further, one or more of Cr: up to 3.5%, Mo: up to 2.0%, Cu: up to 2.0%, Ni: up to 4.0% and B: 0.0005–0.01%, the balance being Fe and inevitable impurities by melting and refining process for the conventional steel making, and adjusting the addition amounts of Al and Ca in such a manner as to satisfy the ranges of S, Al and Ca, and the conditions set forth in claim 6.

8. A method of producing the free-cutting steel for machine structural use having good machinability in machining with a cemented carbide tool set forth in claim 3, comprising the steps of preparing an alloy consisting essentially of, by weight %, C: 0.05–0.8%, Si: 0.01–2.5%, Mn: 0.1–3.5% and O: 0.0005–0.01%, the balance being Fe and inevitable impurities by melting and refining process for the conventional steel making, adjusting the addition amounts of Al and Ca in such a manner as to satisfy the ranges of S, Al and Ca, and the conditions set forth in claim 6, and finally, adding one or more of Nb: up to 0.2%, Ti: up to 0.2%, V: up to 0.5% and N: up to 0.04%.

9. A method of producing the free-cutting steel for machine structural use having good machinability in machining with a cemented carbide tool set forth in claim 4, comprising the steps of preparing an alloy consisting essentially of, by weight %, C: 0.05–0.8%, Si: 0.01–2.5%, Mn: 0.1–3.5% and O: 0.0005–0.01%, the balance being Fe and inevitable impurities by melting and refining process for the conventional steel making, adjusting the addition amounts of Al and Ca in such a manner as to satisfy the ranges of S, Al and Ca, and the conditions set forth in claim 6, and finally, adding one or more of Ta: up to 0.5%, Zr: up to 0.5% and Mg: up to 0.02%.

10. A method of producing the free-cutting steel for machine structural use having good machinability in machining with a cemented carbide tool set forth in claim 5, comprising the steps of preparing an alloy consisting essentially of, by weight %, C: 0.05–0.8%, Si: 0.0 1–2.5%, Mn: 0.1–3.5% and O: 0.0005–0.01%, and further, at least one of Pb: up to 0.4%, Bi: up to 0.4%, Se: up to 0.4%, Sn: up to 0.1% and Ti: up to 0.05%, the balance being Fe and inevitable impurities by melting and refining process for the conventional steel making, and adjusting the addition amounts of Al and Ca in such a manner as to satisfy the ranges of S, Al and Ca, and the conditions set forth in claim 6.

* * * * *